US006120131A

United States Patent [19]

Murthy et al.

[11] Patent Number: 6,120,131

[45] Date of Patent: Sep. 19, 2000

[54] METHOD OF FORMING AN INKJET PRINTHEAD NOZZLE STRUCTURE

[75] Inventors: Ashok Murthy; Steven Robert Komplin; Gary Raymond Williams; Tonya Harris Jackson, all of Lexington, Ky.

[73] Assignee: Lexmark International, Inc., Lexington, Ky.

[21] Appl. No.: 08/966,281

[22] Filed: Nov. 7, 1997

Related U.S. Application Data

[63] Continuation-in-part of application No. 08/519,906, Aug. 28, 1995.

[51] Int. Cl.[7] ..... B41J 2/14

[52] U.S. Cl. ..... 347/47

[58] Field of Search ..... 347/47; 219/121.69, 219/121.71, 121.85

[56] References Cited

U.S. PATENT DOCUMENTS

| | | | |
|---|---|---|---|
| 4,169,008 | 9/1979 | Kurth | 156/600 |
| 4,239,954 | 12/1980 | Howard et al. | 219/121 |
| 4,770,740 | 9/1988 | Tsuzuki et al. | 156/644 |
| 4,847,630 | 7/1989 | Bhaskar et al. | 346/1.1 |
| 4,948,645 | 8/1990 | Holzinger et al. | 428/40 |
| 4,948,941 | 8/1990 | Altman et al. | 219/121.71 |
| 5,312,517 | 5/1994 | Ouki | 156/643 |
| 5,350,616 | 9/1994 | Pan et al. | 428/131 |
| 5,505,320 | 4/1996 | Burns et al. | 216/13 |
| 5,594,479 | 1/1997 | Inoue et al. | 347/45 |
| 5,656,229 | 8/1997 | Tanimoto et al. | 263/300 |
| 5,703,631 | 12/1997 | Hayes et al. | 347/47 |

FOREIGN PATENT DOCUMENTS

| | | | |
|---|---|---|---|
| 0 178 596 A2 | 10/1985 | European Pat. Off. | B41J 3/04 |
| 534414 | 3/1993 | European Pat. Off. . | |
| 0 576 007 A2 | 6/1996 | European Pat. Off. | B41J 2/16 |
| 58-110190 | 6/1993 | Japan | B23K 26/00 |
| 2 241 186 | 2/1990 | United Kingdom | B23K 26/00 |
| WO 93/22141 | 5/1993 | WIPO | B41J 2/16 |

*Primary Examiner*—John Barlow
*Assistant Examiner*—Juanita Stephens
*Attorney, Agent, or Firm*—John A. Brady; David E. LaRose

[57] ABSTRACT

A composite structure containing a nozzle layer and an adhesive layer is provided and the adhesive layer is coated with a polymeric sacrificial layer. The coated composite structure is laser ablated to form one or more nozzles in the structure and the sacrificial layer is removed. The sacrificial layer is preferably a water soluble polymer, such as polyvinyl alcohol or polyethylene oxide, which is removed by directing jets of water at the sacrificial layer until it is substantially removed from the adhesive layer.

34 Claims, 2 Drawing Sheets

METHOD OF FORMING AN INKJET PRINTHEAD NOZZLE STRUCTURE

This application is a continuation-in-part application of U.S. patent application Ser. No. 08/519,906, filed Aug. 28, 1995, the disclosure of which is incorporated herein by reference.

FIELD OF THE INVENTION

The present invention relates to inkjet printheads, and more particularly to an improved fabrication technique for the nozzle structures for inkjet printheads.

BACKGROUND OF THE INVENTION

Printheads for inkjet printers are precisely manufactured so that the components cooperate with an integral ink reservoir to achieve a desired print quality. Despite the precision, the printheads containing the ink reservoir are disposed of when the ink supply in the reservoir is exhausted. Accordingly, the components of the assembly need to be relatively inexpensive so that the total per page printing cost, into which the life of the assembly is factored, can be kept competitive in the marketplace with other forms of printing.

Typically the ink, and the materials used to fabricate the reservoir and the printhead, are not the greatest portion of the cost of manufacturing the printhead assembly. Rather, it is the labor intensive steps of fabricating the printhead components themselves. Thus, efforts which lower the cost of producing the printhead have the greatest effect on the per page printing cost of the inkjet printer in which the printhead assembly is used.

One method for lowering the cost for production of printheads is to use manufacturing techniques which are highly automated. This saves the expense of paying highly skilled technicians to manually perform each of the manufacturing steps. Another method for reducing production costs is to improve the overall yield of the automated manufacturing process. Using a higher percentage of the printheads produced reduces the price per printhead thus spreading out the cost of manufacture over a greater number of saleable pieces. Since process yields tend to increase as the number of process steps required to manufacture a part decrease, it is desirable to reduce the number of process steps required to manufacture the printhead, or replace complex, low yield process steps with simpler, higher yield process steps.

Inkjet printheads are often formed from two or three major components including, 1) a substrate containing resistance elements to energize a component in the ink, and 2) an integrated flow features/nozzle layer to direct the motion of the energized ink. The flow features of the printhead may be contained in the nozzle layer or in a separate layer attached to the nozzle layer or substrate. The individual features which must cooperate during the printing step are contained in the components, which are joined together before use. Typically, an adhesive is used to join the components of the printhead into a unitary structure.

If the adhesive is applied to one of the components before the manufacturing steps for that component are completed, then the adhesive layer may retain debris created during subsequent manufacturing steps. Often the debris is difficult to remove, and at the very least requires extra processing steps to remove, thus increasing the cost of the printhead. Additionally, if the debris is not completely removed the adhesive bond between the substrate and the nozzle layer may be impaired, resulting in a printhead which either functions improperly, or does not exhibit the expected utility lifetime. Therefore, the yield reduction caused by unremoved debris increases the cost of producing the printheads.

If the adhesive is applied to one of the components after the features are formed in that component, additional labor intensive steps are required to ensure that the adhesive is positioned on the portions of the component that are to be used as bonding surfaces, and that the adhesive is removed from those portions of the component whose function will be inhibited by the presence of the adhesive. Not only do these extra steps add to the cost of the printhead, but any error in positioning the adhesive on the components will tend to reduce the yield of product from the printhead manufacturing process.

For example, if adhesive is left in a portion of the component such as a flow channel for the ink, then the proper function of that flow channel will be inhibited, and the printhead will be unusable. Alternately, if the adhesive does not adequately cover the bonding surfaces between the components, then the components may separate, allowing ink to leak from the completed assembly. Both of these conditions will lower the product yield, thereby increasing the cost of the printheads produced, as explained above.

It is an object of this invention, therefore, to provide a method for manufacturing an inkjet printhead that is highly automated.

It is another object of this invention to provide an inkjet manufacturing method that does not require additional process steps for the alignment and removal of adhesive.

It is a further object of this invention to provide a method for manufacturing an inkjet printhead in which the adhesive used to join the components does not attract and retain debris through subsequent process steps.

SUMMARY OF THE INVENTION

The foregoing and other objects are provided by a method for making an inkjet printhead nozzle member according to the present invention. In the present invention a composite structure containing a nozzle layer and an adhesive layer is provided, and the adhesive layer is coated with a polymeric sacrificial layer. The coated composite structure is then laser ablated to form one or more nozzles in the structure. After forming the nozzles, the sacrificial layer is removed.

The sacrificial layer is preferably a water soluble polymeric material, such as polyvinyl alcohol or polyethylene oxide, which may be removed by directing jets of water at the sacrificial layer until substantially all of the sacrificial layer has been removed from the adhesive layer.

During the critical laser ablation step, slag and other debris created by laser ablating the composite structure often adheres to the sacrificial layer rather than to the adhesive layer. Since the sacrificial layer is water soluble, it may readily be removed by a simple washing technique, and as a result of removal, will carry with it the debris adhered thereto. In this manner the nozzle structure is freed of the debris which may cause structural or operational problems without the use of elaborate cleaning processes. Furthermore, the adhesive may be applied directly to the nozzle structure before the nozzles are created by laser ablation, thus simplifying the manufacturing process.

BRIEF DESCRIPTION OF THE DRAWINGS

Further objects and advantages of the invention will become apparent by reference to a detailed description of preferred embodiments when considered in conjunction with the following drawings, in which like reference numerals denote like elements throughout the several views, and wherein.

DESCRIPTION OF THE PREFERRED EMBODIMENTS

Figure 1:
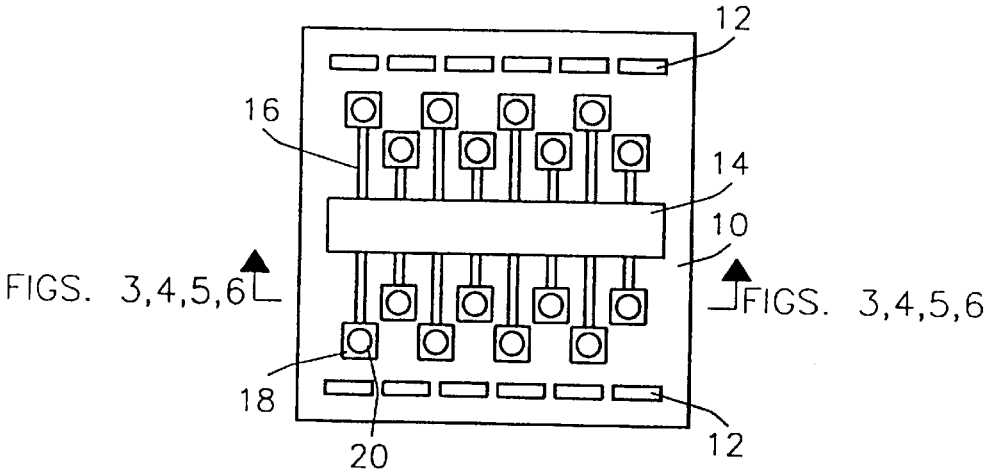
FIG. 1 is top plan view, not to scale, of a nozzle layer of a composite structure of a printhead.

Referring now to the drawings, there is depicted in FIG. 1 a plan view representation of the major features of a nozzle layer 10 of a printhead composite structure. The nozzle layer 10 is a polymeric material such as polyimide, polyester, fluorocarbon polymer, or polycarbonate, which is preferably about 15 to about 200 microns thick, and most preferably about 75 to about 125 microns thick.

The material from which the nozzle layer 10 is formed may be supplied in a continuous elongate strip of polymeric material from which many nozzle layers may be formed, one after another, in a continuous or semi-continuous process. To aid in handling and providing for positive transport of the elongate strip of polymeric material through the manufacturing steps, sprocket holes or apertures 12 may be provided in the strip.

Several important features may be formed in the nozzle layer 10, by processes that will be more fully described below. There is an ink distribution channel 14, which receives ink from an ink reservoir (not shown) and supplies the ink to flow channels 16. The flow channels 16 receive the ink from the ink distribution channel 14, and supply it to resistance elements (not shown) below the bubble chambers 18.

Upon energizing one or more resistance elements, a component of the ink is vaporized, imparting mechanical energy to a portion of the ink, thereby ejecting the ink through a corresponding nozzle 20 of the nozzle layer 10. The ink exiting the nozzle 20 then impacts the print medium, yielding a predefined pattern of ink spots which become alpha-numeric characters and graphic images.

Figure 3:
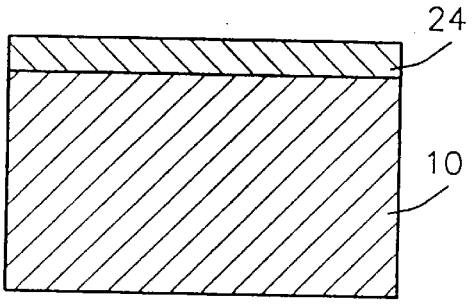
FIG. 3 is a cross-sectional view, not to scale, of a composite structure in which the nozzle layer is formed.
Figure 2:
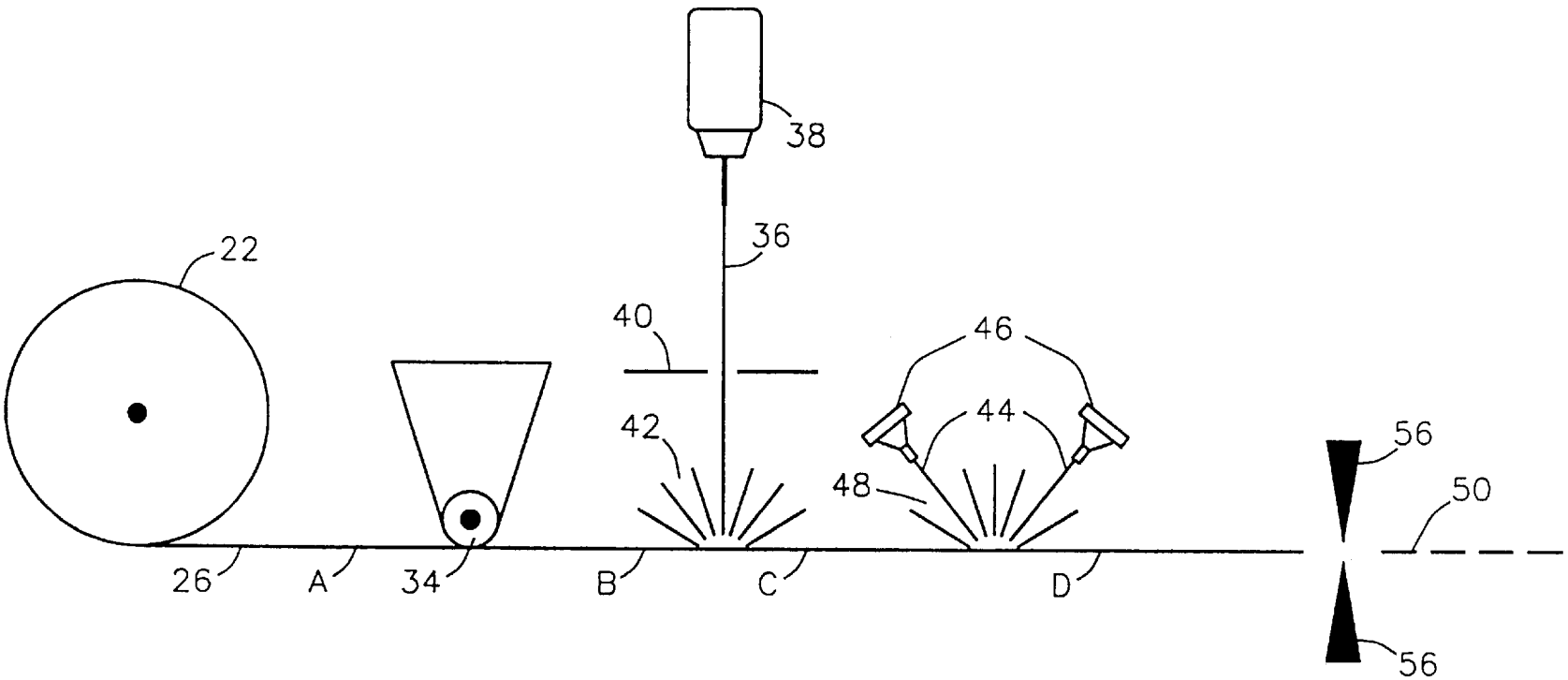
FIG. 2 is a diagrammatical representation of the manufacturing method of the present invention.

The strip of material in which the nozzle layer 10 is formed may be provided on a large reel 22 such as that schematically illustrated in FIG. 2. Several manufacturers, such as Ube (of Japan) and E.I. duPont de Nemours & Co. of Willimington, Del., commercially supply materials suitable for the manufacture of the nozzle layer, under the trademarks of UPILEX or KAPTON, respectively. The preferred nozzle layer materials are formed from a polyimide tape, overlaid with an adhesive layer 24 as depicted in FIG. 3.

The adhesive layer 24 is preferably any B-stageable material which may include thermoplastic macromolecular materials. Examples of B5 stageable thermal cure resins include phenolic resins, resorcinol resins, urea resins, epoxy resins, ethylene-urea resins, furane resins, polyurethanes, and silicon resins. Suitable macromolecular thermoplastic, or hot melt, materials include ethylene-vinyl acetate, ethylene ethylacrylate, polypropylene, polystyrene, polyamides, polyesters and polyurethanes.

In the most preferred embodiment, the adhesive layer 24 is a phenolic butyral adhesive film such as that used in the laminate RFLEX R1100 (a laminate comprising a 2.0 mil UPILEX nozzle layer and a 0.5 mil phenolic butyral adhesive film layer) or RFLEX R1000 (a laminate comprising a 2.0 mil KAPTON nozzle layer and a 0.5 mil phenolic butyral adhesive film layer), commercially available from Rogers of Chandler, Ariz. At the position labeled "A" in FIG. 2, the composite structure of nozzle layer 10 and adhesive layer 24 has the cross-sectional configuration depicted in FIG. 3. For most applications, the adhesive layer 24 is about 1 to about 25 microns in thickness.

Figure 4:
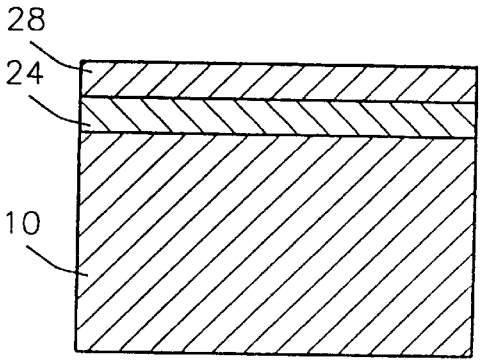
FIG. 4 is a cross-sectional view, not to scale, of the composite structure containing a sacrificial layer.

The adhesive layer 24 is coated with a sacrificial layer 28 as depicted in FIG. 4. The sacrificial layer 28 may be any polymeric material that is both coatable in thin layers and removable by a solvent that does not interact with the adhesive layer 24 or the nozzle layer 10. The preferred solvent is water, and polyvinyl alcohol and polyethylene oxide are examples of suitable water soluble sacrificial layer materials.

Commercially available polyvinyl alcohol materials which may be used as the sacrificial layer include AIRVOL 165, available from Air Products Inc., EMS1146 from Emulsitone Inc., and various polyvinyl alcohol resins from Aldrich. Commercially available polyethylene oxides which may be used as sacrificial layer materials are available from Aldrich and include polyethylene oxides of molecular weights between about 100,000 and 1,000,000 and most preferably from about 100,000 to about 200,000. The sacrificial layer 28 is most preferably at least about 1 micron in thickness, and is preferably coated onto the adhesive layer 24, which is on the polyimide carrier sheet which forms the nozzle layer 10. Polyethylene oxide sacrificial layer material has a remarkably high level of adhesion to the adhesive layer 24 and therefore does not delaminate even in the regions immediately adjacent to the impinging laser beam. Furthermore, polyethylene oxide has a high enough melt viscosity that hot slag and other debris generated during a laser ablation process, e.g., carbon particles, cannot tunnel through the entire thickness of the sacrificial layer 28 and thus come in contact with the underlying adhesive and nozzle layers 24 and 10. Hence, when the polyethylene oxide sacrificial layer 28 is washed away, it carries with it substantially all the debris that landed on it. Additionally, polyethylene oxide is totally unreactive with any of the components of the adhesive layer 24, e.g., a phenolic adhesive layer. Therefore, polyethylene oxide is a highly stable sacrificial layer material. Optionally, a surfactant may be mixed in with the coating solution of polyethylene oxide in order to allow the polyethylene oxide to coat the adhesive layer 24 uniformly. Any one of a number of commercially available surfactants may be used for this purpose. An example of such a surfactant is one which is commercially available from Union Carbide under the product designation Tergitol NP-10.

A conventional ASTM D3359-83 procedure (Method A) for assessing the adhesion of a coating to a substrate was used to test the level of adhesion of polyvinyl alcohol and polyethylene oxide sacrificial layers to a phenolic resin film layer of an adhesive film layer/nozzle layer structure. The polyethylene oxide sacrificial layer consistently passed the ASTM test while the polyvinyl alcohol layer typically failed the test, i.e., the polyvinyl alcohol layer was consistently removed from the underlying phenolic resin film by tape during testing. A less sensitive peel test procedure was also used to test the level of adhesion of the two sacrificial layers to a phenolic resin film layer of an adhesive film layer/nozzle layer structure. The test involved the following steps:

1) The four corners of a composite structure comprising a nozzle layer, a phenolic butyral adhesive film and a sacrificial layer was taped to a rigid substrate. The composite structure was not cut or scribed in any way.
2) Two complete laps of tape (0.75 inch width medium tack pressure sensitive office supply tape (Highland 6200 tape)) were removed and discarded. An additional length of tape, e.g., about a 3 inch long length, was removed at a steady rate and cut.
3) The center of the tape was placed on the composite structure such that about 1 inch of the tape extended beyond one edge of the composite structure.
4) Within a time period of about 90+/−30 seconds of application, the tape was removed by seizing the free end and rapidly (not jerked) pulling it off at as close to an angle of 180° as possible.
5) The tape and the composite structure were inspected. Both sacrificial layers passed the test as there was no transfer of the sacrificial layers to the tape. Had one of the sacrificial layers peeled from the phenolic butyral adhesive film layer and transferred to the tape, then that sacrificial layer would have failed the test.

Methods such as extrusion, roll coating, brushing, blade coating, spraying, dipping, and other techniques known to the coatings industry may be used to coat the composite strip 26 with the sacrificial layer 28. The composite strip 26 may be supplied in sheet form or in roll form prior to coating. When the composite strip 26 is in roll form, the preferred coating method is a conventional Mayer rod coating process, also known as metering rod coating. The polyethylene oxide bonds sufficiently by air drying. However, during roll coating, heating of the strip 26 by passing it through an oven heated to a temperature of about 100° C. is preferred to accelerate drying.

As illustrated by FIG. 2, the sacrificial layer 28 may be coated onto the composite strip 26 such as by coating roller 34. At position B (FIG. 2), the composite strip 26 now has a cross-sectional dimension as depicted in FIG. 4, with the adhesive layer 24 disposed between the nozzle layer 10 and the sacrificial layer 28.

The features of the nozzle layer 10, such as distribution channel 14, flow channels 16, bubble chambers 18, and nozzles 20 as depicted in FIG. 1, are preferably formed by laser ablating the composite strip 26 in a predetermined pattern. A laser beam 36 for creating flow features in the nozzle layer 10 may be generated by a laser 38, such as an $F_2$, ArF, KrCl, KrF, or XeCl excimer or frequency multiplied YAG laser.

Laser ablation of the composite structure of FIG. 4 is accomplished at a power of from about 100 millijoules per centimeter squared to about 5,000 millijoules per centimeter squared, and preferably about 1,500 millijoules per centimeter squared. During the laser ablation process, a laser beam with a wavelength of from about 150 nanometers to about 400 nanometers, and most preferably about 248 nanometers, is applied in pulses lasting from about one nanosecond to about 200 nanoseconds, and most preferably about 20 nanoseconds.

Specific features of the nozzle layer 10 are formed by applying a predetermined number of pulses of the laser beam 36 through a mask 40 which is used for accurately positioning the flow features in the nozzle layer. Many energy pulses may be required in those portions of the nozzle layer 10 from which a greater cross-sectional depth of material is removed, such as the nozzles 20, and fewer energy pulses may be required in those portions of the nozzle layer 10 which require that only a portion of the material be removed from the cross-sectional depth of the nozzle layer 10, such as the flow channels 16, as will be made more apparent hereafter.

The side boundaries of the features of the nozzle layer 10 are defined by the mask 40 which allows the laser beam 36 to pass through holes in the mask 40 in certain portions of the mask 40 and inhibits the laser beam 36

During the laser ablation process of the composite strip 26 containing a sacrificial layer 28, slag and other debris 42 are formed. At least a portion of the debris 42 may land on and adhere to strip 26. In the present invention, since the top layer of the strip 26 contains the sacrificial layer 28, the debris 42 lands on and adheres to the sacrificial layer 28 rather than to the adhesive layer 24.

If the composite strip 26 did not have the sacrificial layer 28, then the debris 42 would land on and adhere to the adhesive layer 24. Once adhered to the adhesive layer 24, the debris 42 may be difficult to remove, requiring complicated cleaning procedures or resulting in unusable product. The present invention not only makes removal of the debris 42 easier, but may also increase yield due to a reduction in non-usable product.

Figure 5:
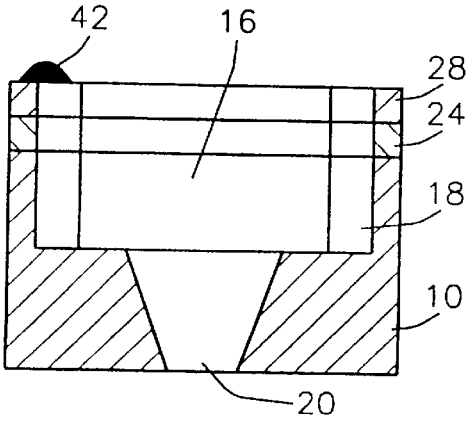
FIG. 5 is a cross-sectional view, not to scale, of the nozzle configuration in the composite structure after laser ablation of the nozzles.

After the laser ablation of the composite strip 26 is completed, the strip 26 at position C has the cross-sectional configuration shown in FIG. 5, as taken through one of the bubble chambers 18. As can be seen in FIG. 5, the nozzle layer 10 still contains adhesive layer 24 which is protected by sacrificial layer 28. Debris 42 is depicted on the exposed surface of the sacrificial layer 28. The relative dimensions of the flow channel 16, bubble chamber 18, and nozzle 20 are also illustrated in FIG. 5.

When the sacrificial layer 28 is a water soluble material, removal of the sacrificial layer 28 and debris 42 thereon may be accomplished by soaking the composite strip 26 in water for a period of time sufficient to dissolve the sacrificial layer 28. The temperature of the water used to remove the sacrificial layer 28 may range from about 20° C. to about 90° C. Higher water temperatures tend to decrease the time required to dissolve the sacrificial layer 28. The temperature and type of solvent used to dissolve the sacrificial layer 28 is preferably chosen to enhance the dissolution rate of the material chosen for use as the sacrificial layer 28. Alternatively, the sacrificial layer 28 may be removed by directing water jets 44 toward the strip 26 from water sources 46, see FIG. 2. Brush or sponge contact cleaning may also be used. For example, when the sacrificial layer is formed from polyethylene oxide, only high pressure jets are needed to consistently remove the layer 28 and embedded debris, thus eliminating the need for high temperature processing to effect sacrificial layer removal.

Figure 6:
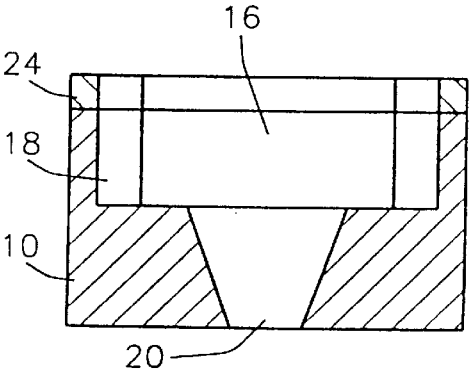
FIG. 6 is a cross-sectional view, not to scale, of the completed composite structure after removal of the sacrificial layer.

The debris 42 and sacrificial layer 28 removed from the adhesive layer are contained in an aqueous waste stream 48 that is removed from the strip 26. After removal of the sacrificial layer 28, the adhesive coated composite structure at position D has a cross-sectional configuration illustrated in FIG. 6. As can be seen in FIG. 6, the structure contains the nozzle layer 10 and the adhesive layer 24, but the sacrificial layer 28 which previously coated the adhesive layer 24 has been removed. Sections 50 of the nozzle layer 10 are separated one from another by cutting blades 56 and are then subsequently attached to silicon heater substrates. The adhesive layer 24 is used to attach the nozzle layer 10 to the silicon substrate.

Since the debris 42 formed during laser ablation of the nozzle layer 10 was adhered to the sacrificial layer 28, removal of the sacrificial layer 28 also removed substantially all of the debris 42 formed during the laser ablation step. Because a water soluble sacrificial layer 28 is used, removal of the sacrificial layer 28 and debris 42 does not require elaborate or time consuming operations. Furthermore, the presence of the sacrificial layer 28 during the laser ablation process effectively prevents debris 42 from contacting and adhering to the adhesive layer 24. Accordingly, with the foregoing procedure, the adhesive layer 24 may be attached to the nozzle layer 10, rather than the substrate, prior to laser ablation, thus simplifying the printhead manufacturing process.

Before attaching the nozzle layer 10 to the silicon substrate, it is preferred to coat the silicon substrate with an extremely thin layer of adhesion promoter. The amount of adhesion promoter should be sufficient to interact with the adhesive of the nozzle layer 10 throughout the entire surface of the substrate, yet the amount of adhesion promoter should be less than an amount which would interfere with the function of the substrate's electrical components and the like. The nozzle layer 10 is preferably adhered to the silicon substrate by placing the adhesive layer 24 against the silicon substrate, and pressing the nozzle layer 10 against the silicon substrate with a heated platen.

In the alternative, the adhesion promoter may be applied to the exposed surface of the adhesive layer 24 before application of the sacrificial layer 28, or after removal of the sacrificial layer 28. Well known techniques such as spinning, spraying, roll coating, or brushing may be used to apply the adhesion promoter to the silicon substrate or the adhesive layer. A particularly preferred adhesion promoter is a reactive silane composition, such as DOW CORNING Z6032 SILANE, available from Dow Corning of Midland, Mich.

While preferred embodiments of the present invention are described above, it will be appreciated by those of ordinary skill in the art that the invention is capable of numerous modifications, rearrangements and substitutions of parts without departing from the spirit of the invention.

What is claimed is:

1. A method for making an inkjet printhead nozzle member comprising the steps of:

providing a composite structure containing a polymeric nozzle layer and an adhesive layer, coating the adhesive layer with a polymeric sacrificial layer, laser ablating the coated composite structure to form one or more nozzles therein, and removing the polymeric sacrificial layer from the composite structure.

2. The method of claim 1 wherein the nozzle layer is selected from the group consisting of polyimide, polyester, fluorocarbon polymer, and polycarbonate materials.

3. The method of claim 1 wherein the nozzle layer is from about 15 microns to about 200 microns thick.

4. The method of claim 1 wherein the adhesive layer is selected from the group consisting of phenolics, resorcinols, ureas, epoxies, ethylene-ureas, furanes, polyurethanes, silicones, ethylene-vinyl acetate, ethylene ethylacrylate, polypropylene, polystyrene, polyamides, polyesters, polyurethanes, and acrylics.

5. The method of claim 4 wherein the adhesive layer is phenolic butyral.

6. The method of claim 1 wherein the sacrificial layer is soluble by a solvent that does not react with and dissolve the adhesive layer and the nozzle layer.

7. The method of claim 6 wherein the sacrificial layer is a water soluble polymer.

8. The method of claim 7 wherein the sacrificial layer is polyvinyl alcohol.

9. The method of claim 7 wherein the sacrificial layer is polyethylene oxide.

10. The method of claim 9 wherein the polyethylene oxide is used in conjunction with a surfactant.

11. The method of claim 7 further comprising removing the sacrificial layer from the composite by soaking the composite in water for a period of time sufficient to dissolve the sacrificial layer.

12. The method of claim 7 further comprising removing the sacrificial layer from the composite by directing jets of water at the sacrificial layer until the sacrificial layer is substantially removed from the adhesive layer.

13. The method of claim 1 wherein the polymeric sacrificial layer is from about one micron to about five microns thick.

14. The method of claim 1 wherein the laser ablation is accomplished with a laser selected from the group consisting of eximer and frequency multiplied YAG lasers.

15. The method of claim 1 wherein the laser ablation is accomplished at a power of from about 100 millijoules per centimeter squared to about 5,000 millijoules per centimeter squared.

16. The method of claim 1 wherein the laser ablation is accomplished at a wavelength of from about 150 nanometers to about 400 nanometers.

17. The method of claim 1 wherein the laser ablation is accomplished by applying the laser energy in pulses lasting from about one nanosecond to about 200 nanoseconds.

18. The method of claim 1 wherein the nozzle layer comprises nozzles and flow features.

19. The method of claim 1 further comprising applying an adhesion promoter to the adhesive layer prior to coating the adhesive layer with the sacrificial layer.

20. The method of claim 19 wherein the adhesion promoter is a reactive silane composition.

21. A method of attaching the nozzle member formed by the method of claim 1 to a silicon substrate comprising the steps of:

applying an adhesion promoter to the silicon substrate, and attaching the nozzle member to the silicon substrate by placing the adhesive layer against the silicon substrate, and pressing the nozzle member against the silicon substrate with a heated platen.

22. The method of claim 21 wherein the adhesion promoter is a reactive silane composition.

23. A method for forming one or more inkjet nozzles in a polymeric material comprising the steps of:

coating one surface of the polymeric material with an adhesive layer, coating the adhesive layer with a polymeric sacrificial layer, thereby forming a three layer composite, and laser ablating one or more apertures in the composite.

24. The method of claim 23 wherein the polymeric material is selected from the group consisting of polyimide, polyester, fluorocarbon polymer, and polycarbonate.

25. The method of claim 23 wherein the adhesive layer is selected from the group consisting of phenolics, resorcinols, ureas, epoxies, ethylene-ureas, furanes, polyurethanes, silicones, ethylene-vinyl acetate, ethylene ethylacrylate, polypropylene, polystyrene, polyamides, polyesters, polyurethanes, and acrylics.

26. The method of claim 23 wherein the sacrificial layer is polyvinyl alcohol.

27. The method of claim 23 wherein the sacrificial layer is polyethylene oxide.

28. The method of claim 27 wherein the polyethylene oxide is used in conjunction with a surfactant.

29. The method of claim 27 further comprising removing the sacrificial layer from the adhesive layer by directing jets of water at the sacrificial layer until the sacrificial layer is substantially removed from the adhesive layer.

30. The method of claim 23 wherein the laser ablation is accomplished with a laser selected from the group consisting of eximer and frequency multiplied YAG lasers.

31. The method of claim 23 further comprising applying an adhesion promoter to the adhesive layer prior to coating the adhesive layer with the sacrificial layer.

32. The method of claim 23 wherein the adhesion promoter is a reactive silane composition.

33. A method of attaching the polymeric material formed by the method of claim 23 to a silicon substrate comprising the steps of:

applying an adhesion promoter to the silicon substrate, and attaching the polymeric material to the silicon substrate by placing the adhesive layer against he silicon substrate, and pressing the polymeric material against the silicon substrate with a heated platen.

34. The method of claim 23 wherein the adhesion promoter is a reactive silane composition.

* * * * *